US006331809B1

(12) United States Patent
Takakuwa et al.

(10) Patent No.: US 6,331,809 B1
(45) Date of Patent: Dec. 18, 2001

(54) NONRADIATIVE DIELECTRIC WAVEGUIDE RESONATOR, NONRADIATIVE DIELECTRIC WAVEGUIDE FILTER, DUPLEXER AND TRANSCEIVER INCORPORATING THE SAME

(75) Inventors: Ikuo Takakuwa, Suita; Toru Tanizaki, Kyoto; Toshiro Hiratsuka, Kusatsu, all of (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 09/330,113

(22) Filed: Jun. 10, 1999

(30) Foreign Application Priority Data

Jun. 10, 1998 (JP) ..... 10-162354

(51) Int. Cl.[7] ..... H01P 3/16; H01P 1/213

(52) U.S. Cl. ..... 333/135; 333/248; 333/208; 333/219.1

(58) Field of Search ..... 333/239, 248, 333/202, 208, 219.1, 249, 135

(56) References Cited

U.S. PATENT DOCUMENTS

| | | | | |
|---|---|---|---|---|
| 3,896,402 | | 7/1975 | Jackson | 333/208 |
| 5,861,782 | * | 1/1999 | Saitoh | 333/239 |
| 5,982,255 | * | 11/1999 | Tanizaki et al. | 333/239 |

FOREIGN PATENT DOCUMENTS 2172462 9/1996 (CA) .

2198963 9/1997 (CA) .

OTHER PUBLICATIONS

T. Yoneyama et al.: "Design of Nonradiative Dielectric Waveguide Filters" IEEE Transactions on Microwave Theory and Techniques, vol. 31, No. 12, Dec. 1984 (Dec. 1984), pp. 1659–1662, pp. 1659–1662.

Wei Hong et al.: "Analysis of the Characteristics of NRD Waveguides Loaded with Periodic Metallic Strips by Using the Method of Ines for Millimeter Wave Filter and Antenna Application" International Journal of Infrared and Millimeter Waves, vol. 11, No. 11, Nov. 1, 1990, pp. 1323–1332.

European Office Action dated Sep. 27, 1999.

* cited by examiner

*Primary Examiner*—Benny Lee
*Assistant Examiner*—Stephen E. Jones
(74) *Attorney, Agent, or Firm*—Ostrolenk, Faber, Gerb & Soffen, LLP

(57) ABSTRACT

A nonradiative dielectric waveguide filter of the present invention permits the manufacturing process including the production of a dielectric strip to be simpler. The filter can be formed by a pillar dielectric strip. The nonradiative dielectric waveguide filter includes resonators, input-output connection units, and cut-off regions, in which the upper and lower conductor plates and a dielectric strip disposed therebetween form the filter. In one example, the main signal-transmitting mode is the LSM mode; a groove having a bottom and conductor walls is disposed in a position in which the conductor plates are opposing; the resonator is formed by fitting the dielectric strip into the groove; and the cut-off regions are formed by second grooves formed in the conductor plates adjacent to the dielectric strip.

11 Claims, 12 Drawing Sheets

NONRADIATIVE DIELECTRIC WAVEGUIDE RESONATOR, NONRADIATIVE DIELECTRIC WAVEGUIDE FILTER, DUPLEXER AND TRANSCEIVER INCORPORATING THE SAME

BACKGROUND OF THE INVENTION

1. Field of the Invention

The present invention relates to a nonradiative dielectric waveguide resonator, a nonradiative dielectric waveguide filter, a duplexer and a transceiver incorporating the same, used in a motor-vehicle-mounted radar in the millimeter wave band and the microwave band, wireless LAN, or the like.

2. Description of the Related Art

A description will be given of a conventional nonradiative dielectric waveguide filter referring to FIG. 23. FIG. 23 is a perspective view of a conventional nonradiative dielectric waveguide filter, in which the upper conductor plate is omitted for convenience sake.

The filter 110*a* is composed of parallel upper and lower conductor plates 111 made of aluminum, etc., and a dielectric strip 112 made of polytetrafluoroethylene, etc., which is disposed between the upper and lower conductor plates 111. The dielectric strip 112 is composed of resonator parts 115 and input-output connection unit parts 116, which are arranged apart from each other. The resonator parts 115 of the dielectric strip 112 and the upper and lower conductor plates 111 form a nonradiative dielectric waveguide resonator, whereas the input-output connection unit parts 116 of the dielectric strip 112 and the upper and lower conductor plates 111 form input-output connection units.

In the nonradiative dielectric waveguide, the distance between the upper and lower conductor plates 111 is set to no more than a half wavelength of the frequency used. This permits a position in which the dielectric strip 112 is present to be a signal-transmitting region and permits a position in which the dielectric strip 112 is not present to be a cut-off region. Thus, signals transmitting through the input-output connection unit couple to the nonradiative dielectric waveguide resonator through the distance between the input-output connection unit parts 116 and the resonator parts 115 of the dielectric strip 112 so as to resonate with a resonance frequency determined, for example, by the length of the signal-transmitting direction of the dielectric strip 112. After coupling to the input-output connection unit, signals are output, in which the nonradiative dielectric waveguide filter 110*a* acts as a band pass filter.

Additionally, a description of another conventional embodiment will be provided referring to a perspective view of FIG. 24. The same reference numerals are given to the same parts as those in the first conventional embodiment, and only a brief explanation is given.

As shown in FIG. 24, the nonradiative dielectric waveguide filter 110*b* employed in a second conventional embodiment is also composed of the upper and lower conductor plates 111 and the dielectric strip 112 disposed between the upper and lower conductor plates 111. In this embodiment, the resonator parts 115 and the input-output connection unit parts 116 of the dielectric strip 112 are connected by a dielectric strip having a narrower width. When the width is significantly narrowed as shown in FIG. 24, the part is allowed to be a cut-off region. Thus, the nonradiative dielectric waveguide filter 110*b* shown in FIG. 24 also acts as a band pass filter, as in the case of the first conventional embodiment.

Primarily, in a nonradiative dielectric waveguide filter, the length of the signal-transmitting direction of a resonator part of a dielectric strip determines a resonance frequency, the distance between resonator parts determines a coefficient of coupling, and the distance between an input-output connection unit part and the resonator part determines an external Q.

In the first conventional embodiment, however, the resonator part and the input-output connection unit part of the dielectric strip are arranged apart from each other. As a result, fine adjustment between their arranged positions is necessary to obtain required characteristics. Furthermore, even after the formation of the nonradiative dielectric waveguide filter, for example, shocks from the outside cause changes in their arranged positions so that filter characteristics are also changed.

Meanwhile, in the second conventional embodiment, since the resonator part and the input-output connection unit part of the dielectric strip are connected, their arranged positions are not likely to change. However, it is difficult to manufacture such an approximately 1–2 mm wide dielectric strip so as to make it compliant with required filter characteristics.

SUMMARY OF THE INVENTION

In the light of the above-described problems, the present invention has been made to solve them. It is an object of the present invention to provide a nonradiative dielectric waveguide resonator and a nonradiative dielectric waveguide filter which permit easy manufacturing and have stable characteristics, and a duplexer and a transceiver which incorporate the same.

To this end, according to an aspect of the present invention, there is provided a nonradiative dielectric waveguide resonator including two planar conductors disposed substantially parallel to each other with a dielectric strip disposed therebetween, having substantially constant cross-sectional shape, taken perpendicular to a signal-transmitting direction, at least one resonance region formed within dielectric and cut-off regions formed within the dielectric strip on both sides of the resonance region in the signal-transmitting direction.

This arrangement enables use of the dielectric strip having substantially constant cross-sectional shape, taken perpendicular to a signal-transmission direction, so that a nonradiative dielectric waveguide resonator which permits easy manufacturing and has stable characteristics can be obtained.

Preferably, the dielectric strip of the nonradiative dielectric waveguide resonator is formed of a dielectric material having uniform dielectric constant.

Since this arrangement permits use of the dielectric strip formed of the same material, a nonradiative dielectric waveguide resonator, which can be more easily manufactured, is obtainable.

Furthermore, in the nonradiative dielectric waveguide resonator, a main signal-transmitting mode is preferably the LSM mode; a first groove having a bottom and conductor walls may be disposed in a position in which the conductors are opposing; the resonance region may be formed by fitting the dielectric strip into the first groove; and the cut-off regions may be formed either by a second groove having lower conductor walls than those of the first groove or by portions of the conductors having no grooves.

This permits a nonradiative dielectric waveguide resonator using the LSM mode to be easily obtained.

Furthermore, the first groove of the nonradiative dielectric waveguide resonator may include a bottom and conductor walls of a specified height or higher.

This permits use of the LSM mode as a single mode at the used frequency.

Additionally, in the nonradiative dielectric waveguide resonator, a main signal-transmitting mode may be the LSE mode; a first groove having a bottom and conductor walls may be disposed in a position in which the conductors are opposing; the cut-off regions may be formed by fitting the dielectric strip into the first groove; and the resonance region may be formed either by fitting the dielectric strip into a second groove having lower conductor walls than those of the first groove or by disposing the dielectric strip between the conductors having no grooves.

This permits a nonradiative dielectric waveguide resonator using the LSE mode to be easily obtained.

According to another aspect of the present invention, there is provided a nonradiative dielectric waveguide filter including two planar conductors disposed substantially parallel to each other, a dielectric strip having substantially the same shape of sections, which are perpendicular to a signal-transmitting direction, in which input-output connection units formed by disposing the dielectric strip between the conductors are coupled to the nonradiative dielectric waveguide resonator described above.

This allows a nonradiative dielectric waveguide filter, which can be easily manufactured and has stable characteristics, to be obtained.

Furthermore, in the nonradiative dielectric waveguide filter, a nonradiative dielectric waveguide resonator including two planar conductors disposed substantially parallel to each other and a dielectric strip having substantially the same shape of sections perpendicular to a signal-transmitting direction, the dielectric strip being disposed between the conductors, may have a resonance region and cut-off regions; the input-output connection units may couple to the nonradiative dielectric waveguide resonator, in which a main signal-transmitting mode may be the LSM mode; a first groove comprising a bottom and conductor walls may be disposed in a position in which the conductors are opposing; the resonance region and the input-output connection means may be formed by fitting the dielectric strip into the first groove; and the cut-off regions may be formed either by fitting the dielectric strip into a second groove having lower conductor walls than those of the first groove or by disposing the dielectric strip between the conductors having no grooves.

This allows a nonradiative dielectric waveguide filter using the LSM mode to be easily obtained.

Furthermore, in the nonradiative dielectric waveguide filter, a nonradiative dielectric waveguide resonator including two planar conductors disposed substantially parallel to each other and a dielectric strip having substantially the same shape of sections, which are perpendicular to a signal-transmitting direction, the dielectric strip being disposed between the conductors, may have a resonance region and cut-off regions; the input-output connection units may couple to the nonradiative dielectric waveguide resonator, in which the main signal-transmitting mode may be the LSE mode; a first groove having a bottom and conductor walls may be disposed in a position in which the conductors are opposing; the cut-off regions may be formed by fitting the dielectric strip into the first groove; and the resonance region and the input-output connection units may be formed either by fitting the dielectric strip into a second groove having lower conductor walls than those of the first groove or disposing the dielectric strip between the conductors having no grooves.

This allows a nonradiative dielectric waveguide filter using the LSE mode to be easily obtained.

According to another aspect of the present invention, there is provided a duplexer including at least two filters, input-output connection units connected to the filters, and an antenna connection unit connected to the filters for common use, in which at least one of the filters is the nonradiative dielectric waveguide filter described above.

Furthermore, according to another aspect of the present invention, there is provided a transceiver including the duplexer; a transmission circuit connected to at least one of the input-output connection units of the duplexer; a reception circuit connected to at least one of the input-output connection units, which is different from the input-output connection unit connected to the transmission circuit; and an antenna connected to the antenna connection unit of the duplexer.

These arrangements allows a duplexer and a transceiver, which can be easily manufactured and have stable characteristics, to be obtained.

DESCRIPTION OF THE PREFERRED EMBODIMENTS

Figure 1:
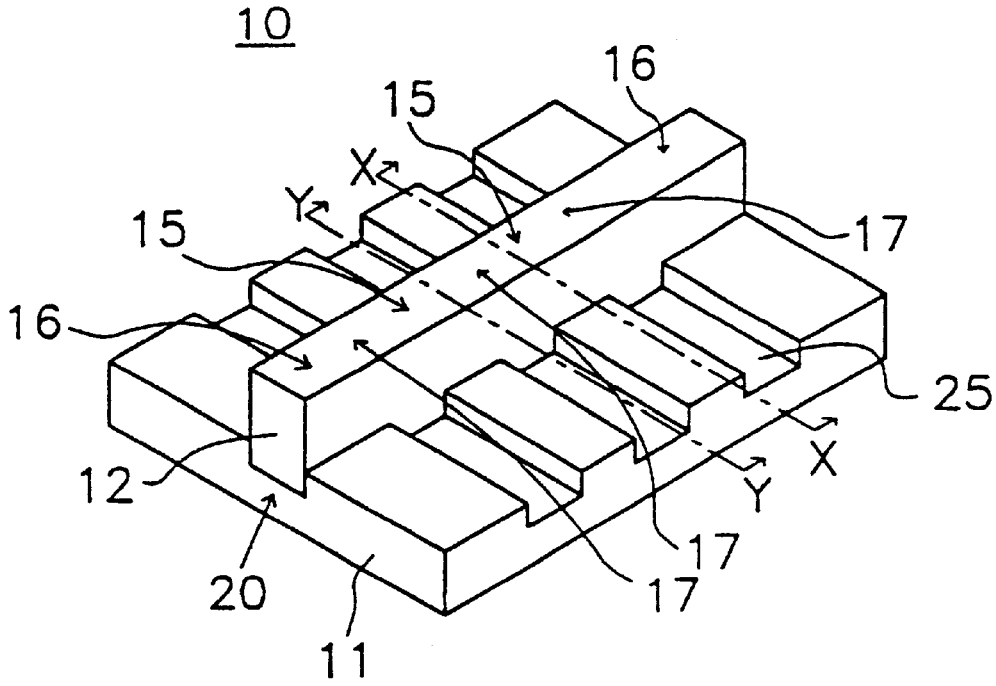
FIG. 1 is a perspective view of a nonradiative dielectric waveguide filter according to the present invention.
Figure 2:
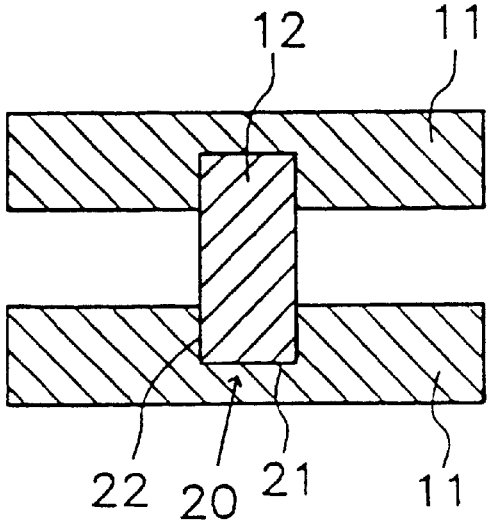
FIG. 2 is a sectional view along the line X—X of the view shown in FIG. 1.
Figure 3:
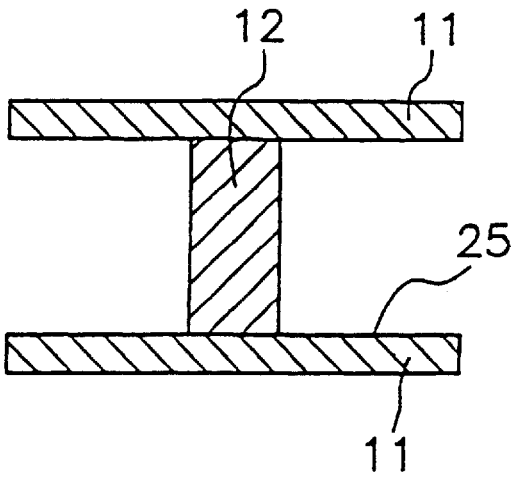
FIG. 3 is a sectional view along the line Y—Y of the view shown in FIG. 1.

Referring now to FIGS. 1 through 3, a description will be given of a nonradiative dielectric waveguide filter according to an embodiment of the present invention. FIG. 1 is a perspective view of the nonradiative dielectric waveguide filter of the present invention. The upper conductor plate thereof is omitted for the sake of convenience.

A nonradiative dielectric waveguide filter 10 of the embodiment comprises parallel upper and lower conductor plates 11 made of, for example, metal-coated resin or aluminum, and a pillar dielectric strip 12 disposed between the upper and lower conductor plates 11. The cross-section of the dielectric strip 12, taken in a direction that is perpendicular to a signal-transmitting direction, has a substantially constant rectangular shape.

A groove 20 of a configuration into which the dielectric strip 12 is fitted is formed in the upper and lower conductor plates 11, and furthermore, lateral grooves 25 are intermittently formed at three parts of the conductor plates on the sides of the dielectric strip 12. In order to illustrate this situation, FIG. 2 shows a sectional view along the line X—X of the perspective view shown in FIG. 1, and FIG. 3 shows a sectional view along the line Y—Y of the same view. As shown in the sectional view of FIG. 2, the side part of the dielectric strip 12, which is fitted into the groove 20 comprising a bottom 21 and conductor walls 22, is partially covered by the conductor walls 22. In contrast, as shown in the sectional view of FIG. 3, at the parts where the lateral grooves 25 are formed, the side of the dielectric strip 12 is not covered by the conductor.

In the nonradiative dielectric waveguide filter 10 having such a structure, the LSM mode is used as a transmission mode. Additionally, setting of frequency, etc., allows the parts where the sides of the dielectric strip 12 are covered by the conductor walls 22 to be signal-transmitting regions, whereas it allows the parts where the sides are not covered by the conductor walls 22 to be cut-off regions 17. Moreover, the signal-transmitting regions serve as resonators 15 and input-output connection means 16, so that the nonradiative dielectric waveguide filter 10 serves as a band pass filter having two resonators.

A detailed explanation will be given of the above-mentioned structure.

Figure 4:
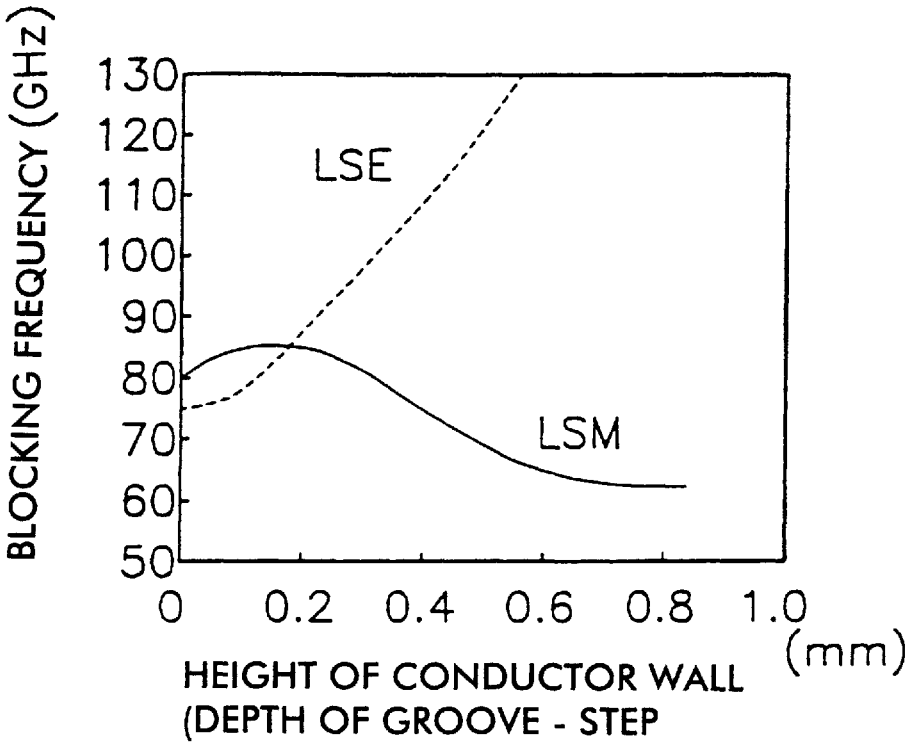
FIG. 4 is a graph showing the relationship between the heights of a conductor wall and block frequencies.

FIG. 4 shows the relationship between the depth of a groove disposed in the conductor plate, namely, the height of the conductor wall, and blocking frequencies. The height of the conductor wall is represented by t in the sectional view of the nonradiative dielectric waveguide shown in FIG. 5. In this case, regarding blocking frequencies, signals of lower frequencies than a specified frequency are not transmitted. The solid line in FIG. 4 shows the relationship between the heights of the conductor wall and blocking frequencies in the case of using the LSM mode, whereas the broken line shows the same relationship in the case of using the LSE mode. Additionally, a dielectric strip, 0.7 mm wide, 1.8 mm high, and having a relative dielectric constant of $\in$,2.04 is used for the nonradiative dielectric waveguide in this case.

In FIG. 4, in the case of using the LSM mode, for example, when no conductor walls are disposed, namely, when t is zero, it is found that signals of frequencies lower than about 80 GHz are blocked. Similarly, when the height of the conductor wall is 0.2 mm, signals of frequencies lower than about 85 GHz are blocked, and when the height of the conductor wall is 0.6 mm, signals of frequencies lower than about 65 GHz are blocked. That is, if a frequency of 76 GHz is used in the LSM mode, the region where the 0.6 mm-deep groove, that is, the conductor wall height of 0.6 mm is disposed in the conductor plate, is a signal-transmitting region, whereas the region where no groove is disposed is a cut-off region. Accordingly, as shown in the above embodiment, it is found that disposing of the groove in the conductor plate to fit the dielectric strip thereinto provides the following arrangement: the parts of the dielectric strip, where the sides are partially covered by the conductor walls of the groove, serve as resonators and input-output connection means, whereas the parts of the dielectric strip, where the sides are not covered by the conductor walls, serve as cut-off regions, when lateral grooves are further disposed in the conductor plate.

In the above embodiment, disposing of the groove 20 in the conductor plate 11 to fit the dielectric strip 12 thereinto yields an arrangement in which the parts of the dielectric strip 12 partially covered by the conductor walls 22 serve as resonators 15 and input-output connection means 16, whereas the parts of the dielectric strip 12 not covered by the conductor walls 22 serve as cut-off regions 17. When the LSM mode is used, however, even changing the depth of the groove, which is represented by t in the sectional view in FIG. 5, enables formation of resonators, input-output connection means, and cut-off regions. In other words, if one groove is 0.6 mm deep, whereas the other is 0.2 mm deep, the deeper groove provides a resonator and an input-output connection means, and the shallower groove provides a cut-off region. However, advantageously the bigger the difference in the depth of the groove or the height of the conductor wall between the place serving as a resonator and an input-output connection means and the place serving as a cut-off region, the wider the usable frequency band.

Figure 5:
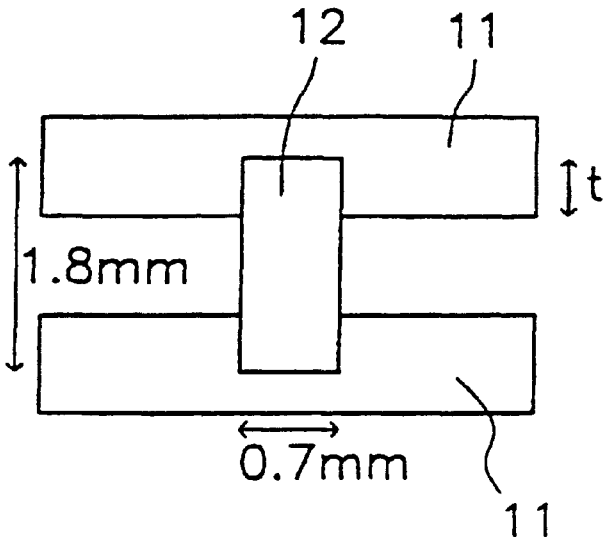
FIG. 5 is a sectional view of a nonradiative dielectric waveguide used in FIG. 4.
Figure 6:
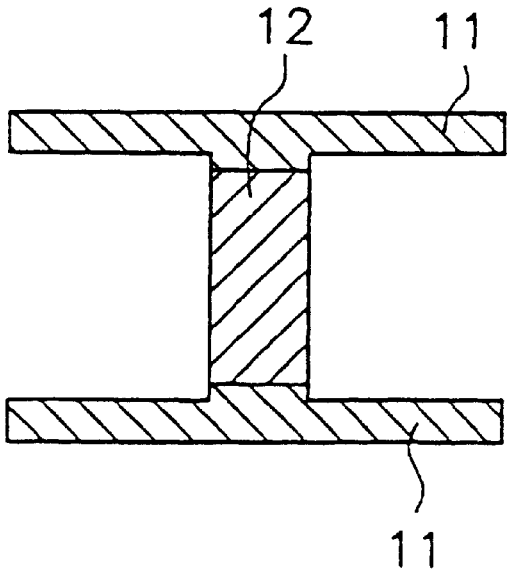
FIG. 6 is a modified configuration of the sectional view along the line Y—Y in FIG. 1.
Figure 7:
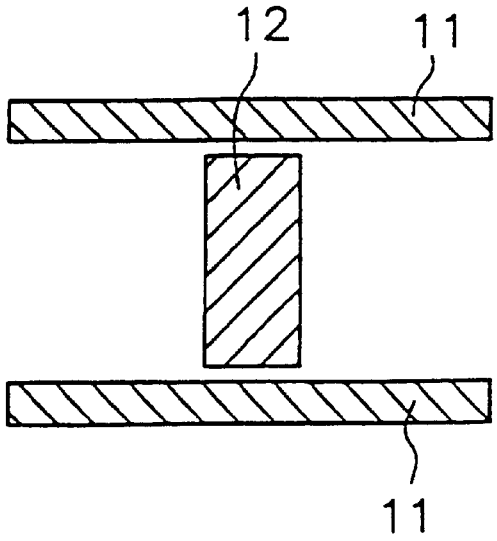
FIG. 7 is a modified configuration corresponding to FIG. 6, of the sectional view along the line Y—Y in FIG. 1.

Additionally, it is possible to make the depth of the groove, namely, t of the sectional view in FIG. 5, a negative value by further widening the lateral groove at the part for using as a cut-off region. That is, as shown in the sectional views of FIGS. 6 and 7, even if the distance between the upper and lower conductor plates 11 is greater than the height of the dielectric strip 12, the region is allowed to serve as a cut-off region as long as the distance is not greater than a half wavelength of the used frequency.

In the graph of FIG. 4 showing the relationship between the heights of the conductor wall, namely, the depths of the groove and blocking frequencies, it may be better to use the height of the conductor wall equivalent to a numeric value existing on the right side from the point of intersection of the LSM mode and the LSE mode for the places serving as a resonator and an input-output connection means. That is, on the right side from the point of intersection of the LSM mode and the LSE mode, the LSM mode is the lowest-level mode, and only the LSM mode as a single mode can be used by selecting frequencies, so that designing such as disposing of a bent part or the like can be easily performed.

Figure 8:
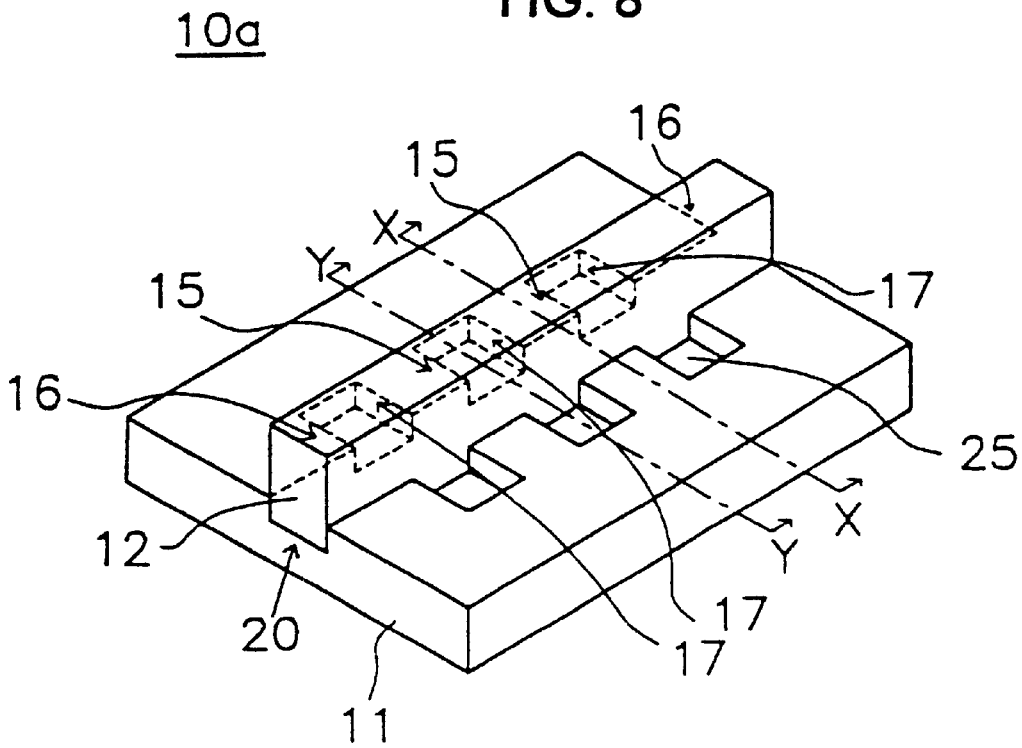
FIG. 8 is a perspective view showing lateral grooves of a different configuration from that in the perspective view of FIG. 1.

Although the perspective view of FIG. 1 shows an example in which the lateral grooves 25 are formed all over the horizontal direction, it may be possible to remove a part of the conductor plate 11 which is near the dielectric strip 12 to form lateral grooves 25 so that a nonradiative dielectric waveguide filter 10*a* can be formed, as shown in the perspective view of FIG. 8.

Furthermore, a description will be given of adjustment in the characteristics of the nonradiative dielectric waveguide filter.

In the nonradiative dielectric waveguide filter 10 of the embodiment as shown in FIG. 1, the length of the signal-transmitting direction of the resonator 15 of the dielectric strip 12 mainly determines a resonance frequency; the distance between the resonators 15 determines the coupling coefficient; and the distance between the input-output connection means 16 and the resonator 15 determines the external Q. In addition, the depths of the groove 20 and the lateral grooves 25 formed in the conductor plate 11 influence a resonance frequency, a coupling coefficient, and an external Q. In this case, a resonance frequency, a coupling coefficient, and an external Q can be adjusted by cutting away a part of the dielectric strip 12, or by adding a material having a dielectric constant different from that of the dielectric strip 12 to the dielectric strip 12. Since these are methods conducted by cutting or adding a small amount of material, the condition does not substantially change in which the shapes of sections perpendicular to the signal-transmitting direction of the dielectric strip 12 are approximately the same.

Moreover, the present invention provides a nonradiative dielectric waveguide filter in which characteristic changes are small with respect to temperature changes. That is, metals such as aluminum generally used for a conductor plate have a smaller linear expansion coefficient than polytetrafluoroethylene used for a dielectric strip. As a result, in the conventional nonradiative dielectric waveguide filter, as the temperature changes, the configuration of the dielectric strip changes more; thereby a significant level of change occurs in the resonance frequency and the like. In the present invention, however, even if the configuration of the dielectric strip changes, the configuration of the conductor plate of the lateral groove, etc., defines a resonator and a cut-off region. Accordingly, influence due to temperature changes can be small, and changes in the characteristics of the nonradiative dielectric waveguide filter are also reduced.

A description will be given of another embodiment of the present invention. In a plurality of embodiments shown below, the same reference numerals are given to the same parts as those of the first embodiment and the detailed explanation is omitted. To facilitate comprehension of the structure, the upper conductor plate is removed as necessary.

Figure 9:
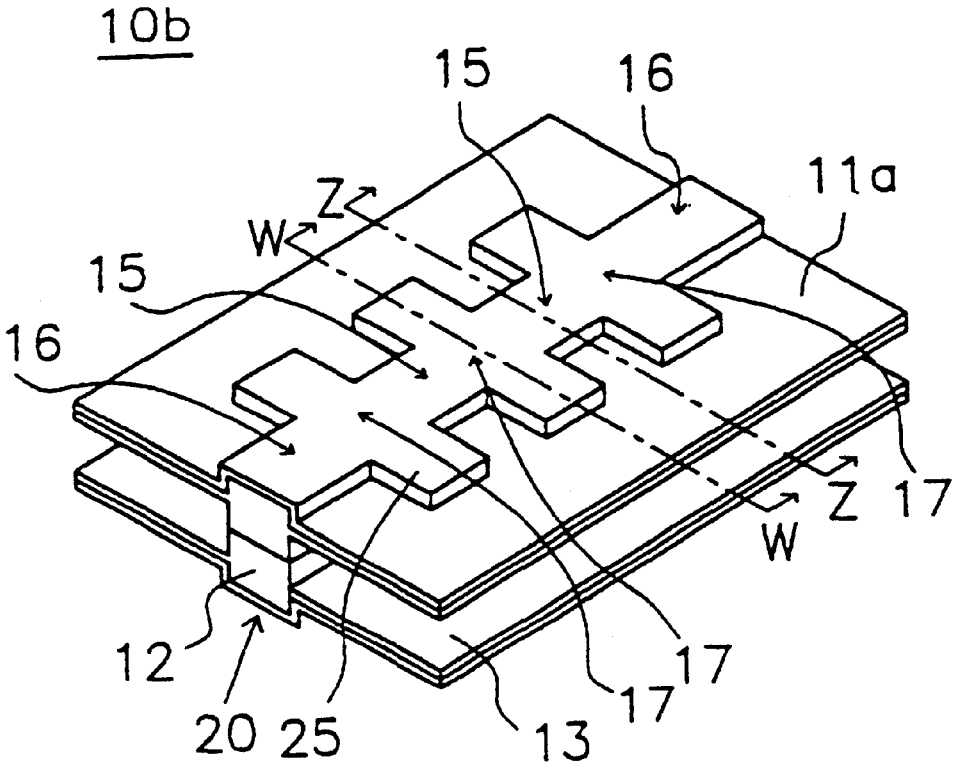
FIG. 9 is a perspective view of a nonradiative dielectric waveguide filter according to a second embodiment of the present invention.
Figure 10:
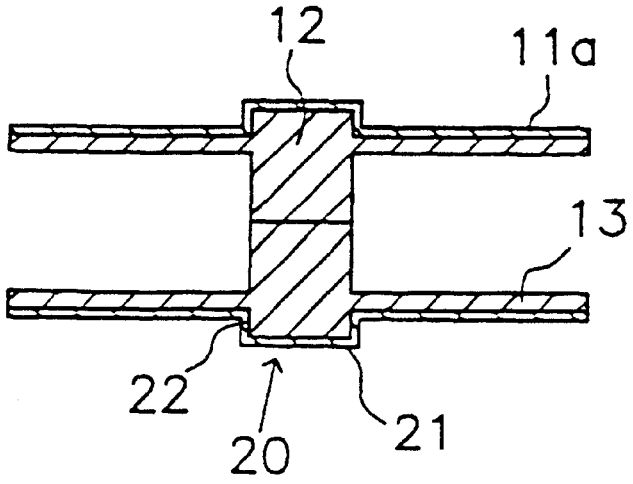
FIG. 10 is a sectional view along the line Z—Z of the view shown in FIG. 9.
Figure 11:
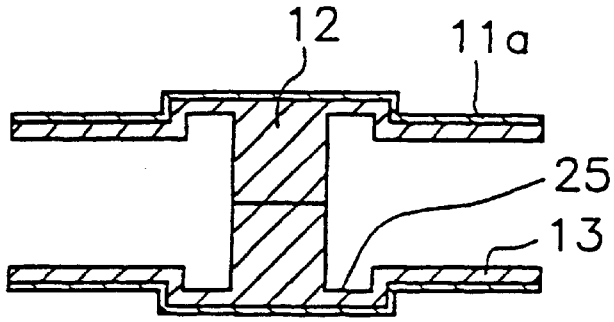
FIG. 11 is a sectional view along the line W—W of the view shown in FIG. 9.

FIG. 9 is a perspective view of a nonradiative dielectric waveguide filter 10*b* according to a second embodiment, FIG. 10 is a sectional view along the line Z—Z of the view shown in FIG. 9, and FIG. 11 is a sectional view along the line W—W of the view shown in FIG. 9.

In the nonradiative dielectric waveguide filter 10*b* of this embodiment, as shown in FIG. 9, two dielectric strips 12 having a brim 13 are bonded together to form the respective upper and lower parts, and a conductor 11*a* is formed on the outer surfaces of the two dielectric strips 12 and on the outer surface of the brim 13. As shown in the sectional view of FIG. 10, the parts where the sides of the dielectric strip 12 are covered by the conductor 11*a* serve as the resonators 15 and the input-output connection means 16. In addition, as shown in the sectional view of FIG. 11, the parts where the sides of the dielectric strip 12 are covered by the conductor 11*a* serve as the cut-off regions 17. This arrangement permits a circuit board to be disposed between the two dielectric strips 12, and the conductor plate employed in the first embodiment is not necessary.

Figure 12:
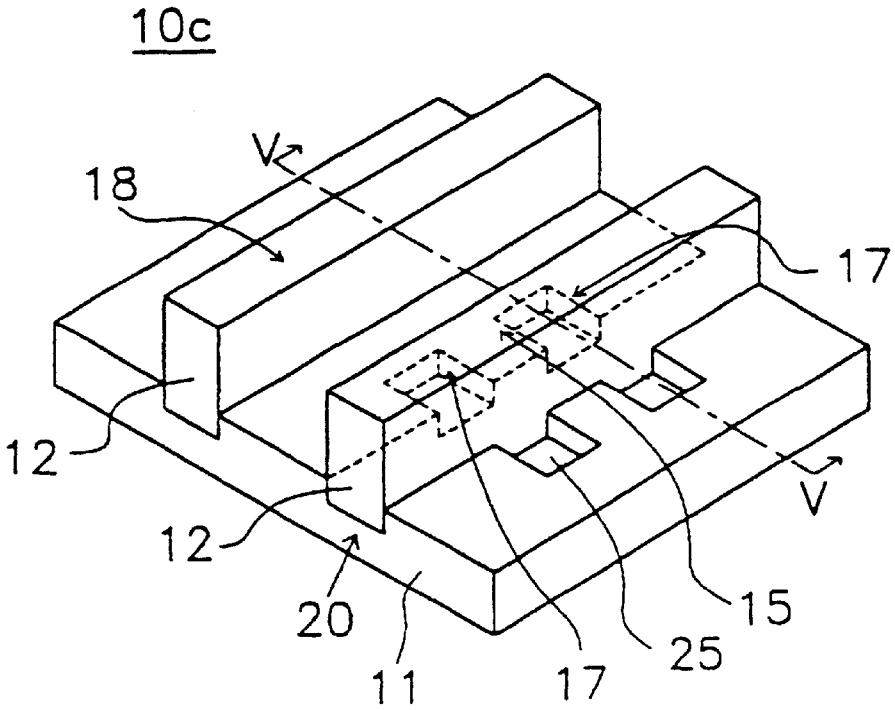
FIG. 12 is a perspective view of a nonradiative dielectric waveguide filter according to a third embodiment of the present invention.
Figure 13:
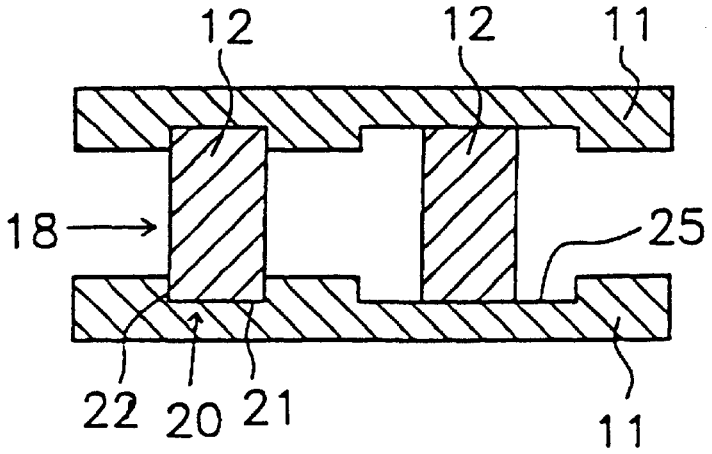
FIG. 13 is a sectional view along the line V—V of the view shown in FIG. 12.

FIG. 12 is a perspective view of a nonradiative dielectric waveguide filter of a third embodiment, and FIG. 13 is a sectional view along the line V—V of the view shown in FIG. 12.

As shown in FIGS. 12 and 13, the nonradiative dielectric waveguide filter 10*c* of this embodiment comprises a main waveguide 18 and a resonator 15, in which the nonradiative dielectric waveguide resonator of the present invention is used as the resonator 15. That is, the dielectric strip 12 is fitted into the groove 20 formed in the conductor plate 11 and the lateral grooves 25 are formed at two parts which are mutually apart on the upper and lower conductor plates 11. When the LSM mode is used, the parts where the lateral grooves 25 are formed serve as the cut-off regions 17, and the part disposed between the cut-off regions 17 serves as the resonator 15. Regarding signals transmitting through the main waveguide 18 comprising the dielectric strip 12 and the upper and lower conductor plates 11, the signals of resonance frequencies determined by the size of the resonator 15 couple to the resonator 15, whereas the other signals transmit through the main waveguide 18. That is, the nonradiative dielectric waveguide filter 10*c* serves as a blocking filter. Regarding the part of the main waveguide 18 coupling to the resonator 15, in order to facilitate release of the coupling to the resonator 15, the upper and lower conductor plates 11 may be partially removed and the depth of the groove 20 may be reduced. The main waveguide 18 and the resonator 15 may be formed in a bent configuration.

Figure 14:
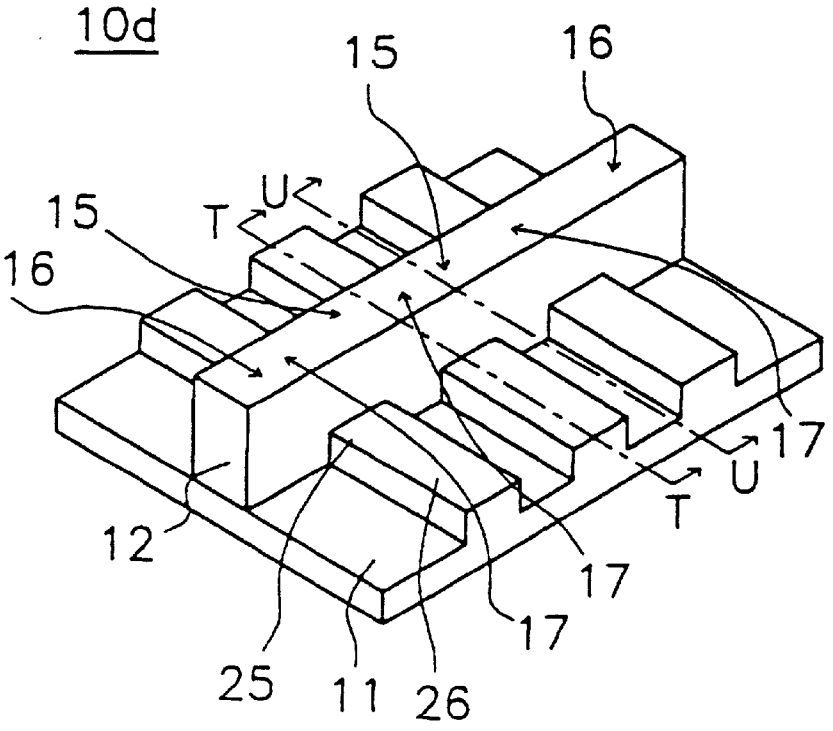
FIG. 14 is a perspective view of a nonradiative dielectric waveguide filter according to a fourth embodiment of the present invention.
Figure 15:
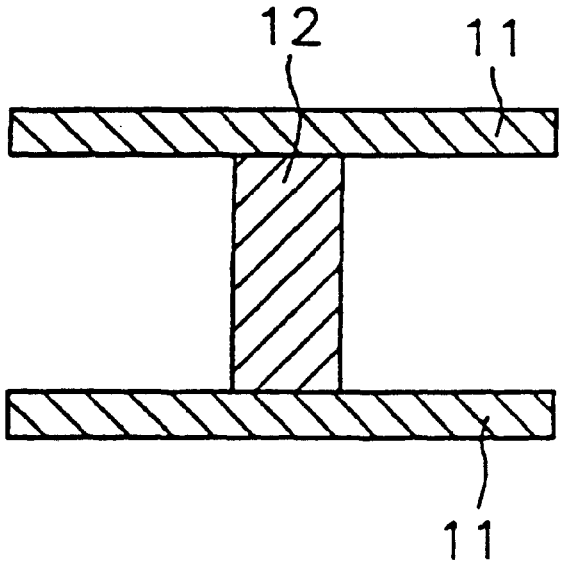
FIG. 15 is a sectional view along the line U—U of the view shown in FIG. 14.
Figure 16:
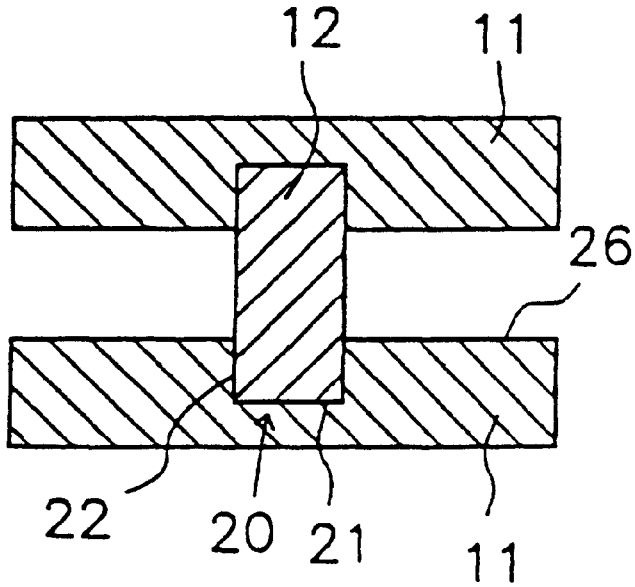
FIG. 16 is a sectional view along the line T—T of the view shown in FIG. 14.

FIG. 14 is a perspective view of a nonradiative dielectric waveguide filter according to a fourth embodiment; FIG. 15 is a section along the line U—U of the view shown in FIG. 14; and FIG. 16 is a section along the line T—T of the view shown in FIG. 14.

As shown in FIG. 14, the nonradiative dielectric waveguide filter 10*d* of this embodiment comprises parallel upper and lower conductor plates 11 made of resin coated with metal, aluminum, or the like, and a pillar dielectric strip 12 disposed between the upper and lower conductor plates 11. The sections perpendicular to the signal-transmitting direction of the dielectric strip 12 have the same rectangular shape.

Three steps 26 of the configuration into which the dielectric strip 12 is fitted are intermittently formed on the upper and lower conductor plates 11, in which a part of the side of the dielectric strip 12 is covered by the conductor. The other part of the side of the dielectric strip 12 is not covered by the conductor. To illustrate the situation, FIG. 15 is a sectional view along the line U—U of the view shown in FIG. 14; and FIG. 16 is a sectional view along the line T—T of the view shown in FIG. 14.

In the nonradiative dielectric waveguide filter 10*d* having such a structure, the LSE mode is used as a transmission mode, and setting of frequencies allows the parts where the side of the dielectric strip 12 is not covered by the conductor to be a signal-transmitting region, whereas it allows the part where the side of the same is covered by the conductor to be a cut-off region 17. The signal-transmitting region serves as the resonator 15 and the input-output connection means 16, and the nonradiative dielectric waveguide filter 10*d* serves as a band pass filter having two resonators.

Referring to FIG. 4, a detailed explanation will be given.

In FIG. 4, it is found that in the case of using the LSE mode, for example, when no steps are disposed, namely, when t is zero, signals of frequencies lower than about 75 GHz are blocked. Similarly, when the height of the step is set to 0.2 mm, signals of frequencies lower than about 87 GHz are blocked; and when the height of the step is set to 0.4 mm, signals of frequencies lower than about 108 GHz are blocked. In other words, when a frequency of 76 GHz is used in the LSE mode, the region, in which a groove with a depth of 0.4 mm, that is, a step with a height of 0.4 mm is formed in the conductor plate, is a cut-off region, whereas the region having no grooves is a signal-transmitting region. Accordingly, disposing the steps on the conductor plate to fit the dielectric strip thereinto, as shown in the above embodiment, allows the side part of the dielectric strip covered by the conductor to serve as a cut-off region, whereas that allows the side part of the same not covered by the conductor to serve as a resonator and an input-output connection means.

Figure 17:
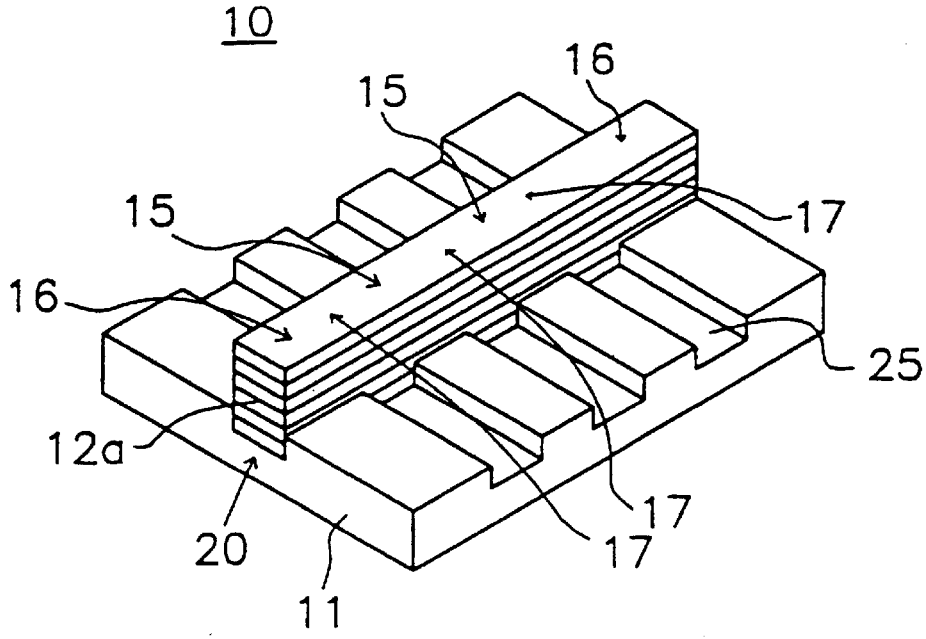
FIG. 17 is a perspective view of a nonradiative dielectric waveguide filter using a dielectric strip made by bonding layer-formed dielectric materials together in the vertical direction.
Figure 18:
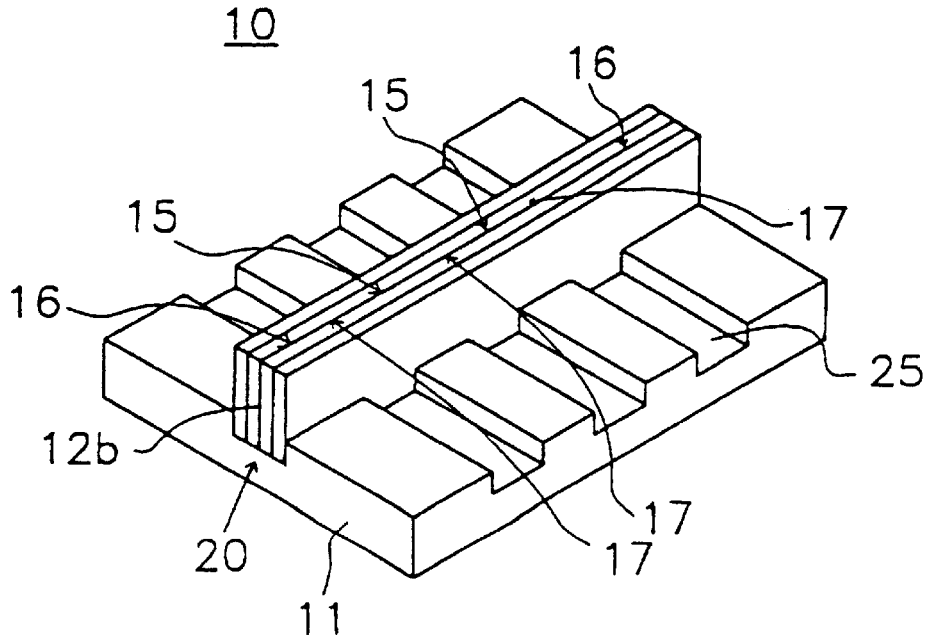
FIG. 18 is a perspective view of a nonradiative dielectric waveguide filter using a dielectric strip made by bonding layer-formed dielectric materials together in the horizontal direction.

Although the above embodiments adopt the dielectric strip formed of the same material from the point of view of easier manufacturing, the dielectric strip used in the present invention should not be limited to this. For example, a dielectric strip 12*a*, as shown in FIG. 17, which is formed by bonding dielectric layers having different specific dielectric constants together in the vertical direction, or a dielectric strip 12*b*, as shown in FIG. 18, which is formed by bonding the same layers together in the horizontal direction, may be applicable. This permits characteristic adjustment.

Furthermore, a description will be given of embodiments of a duplexer and a transceiver of the present invention.

Figure 19:
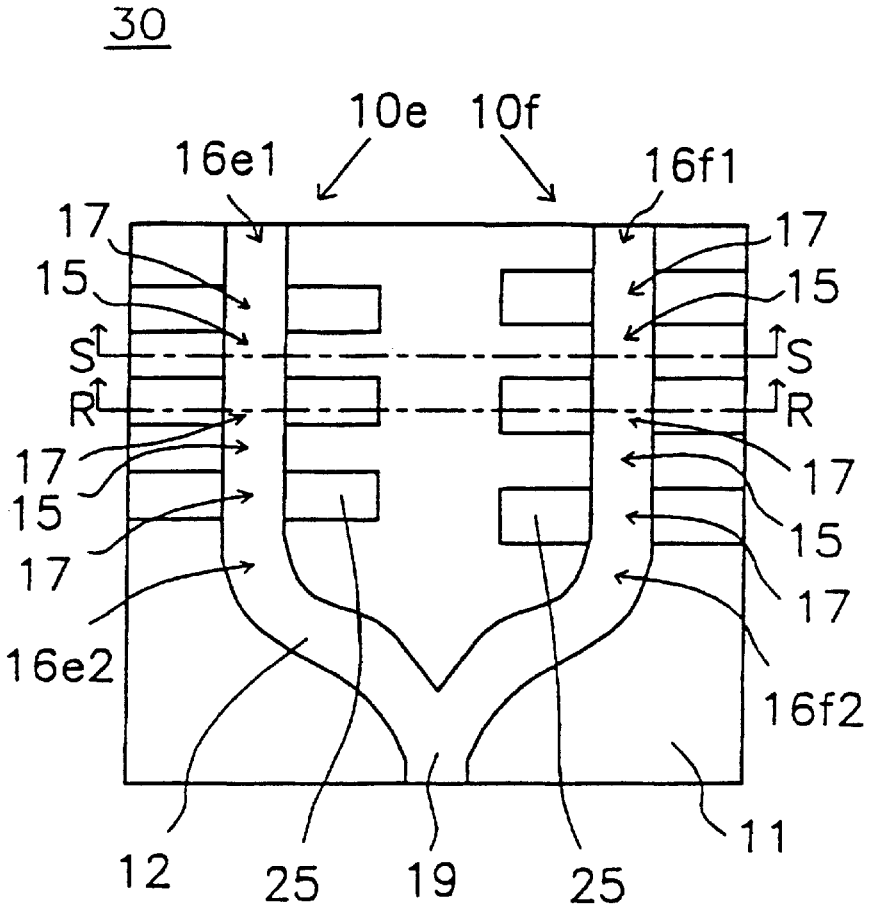
FIG. 19 is a plan view of a duplexer according to the present invention.
Figure 20:
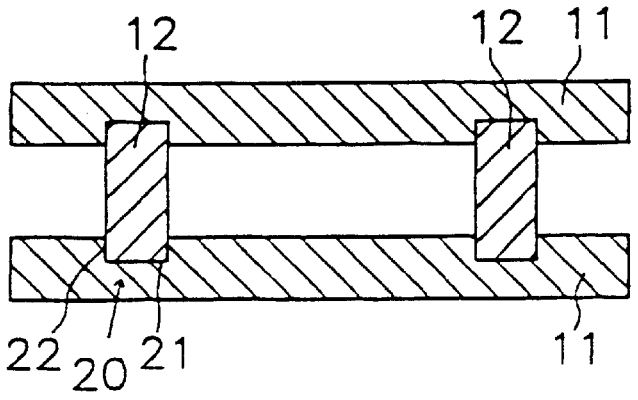
FIG. 20 is a sectional view along the line S—S of the view in FIG. 19.
Figure 21:
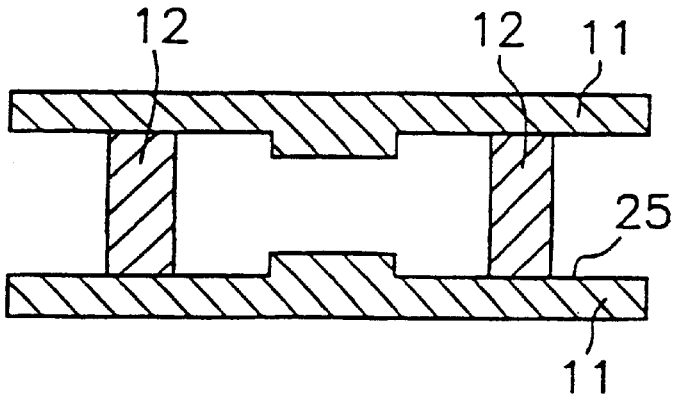
FIG. 21 is a sectional view along the line R—R of the view in FIG. 19.

FIG. 19 is a plan view of the duplexer according to the present invention, FIG. 20 is a section along the line S—S of the plan view shown in FIG. 19, and FIG. 21 is a section along the line R—R of the plan view shown in FIG. 19.

As shown in FIGS. 19 to 21, the duplexer 30 of the present invention comprises a nonradiative dielectric waveguide filter 10*e* comprising the upper and lower conductor plates 11 and the dielectric strip 12, and a nonradiative dielectric waveguide filter 10*f* comprising the upper and lower conductor plates 11 and the dielectric strip 12 and allowing frequencies different from those of the nonradiative dielectric waveguide filter 10*e* to pass through. These two filters 10*e* and 10*f* have the structure described in the first embodiment, in which the dielectric strip 12 is fitted into the groove 20 disposed in the upper and lower conductor plates 11; the sides of the dielectric strip 12 partially covered by the conductor walls 22 serve as the resonators 15 and the input-output connection means 16*e*1 16*e*2, 16*f*1, and 16*f*2, whereas the sides of the strip 12 not covered by the conductor walls 22 due to the formation of the lateral grooves 25 serve as the cut-off regions 17. One of the input-output connection means 16*e*1 of the nonradiative dielectric waveguide filter 10*e* is connected to the external transmission circuit, whereas one of the input-output connection means 16*f*1 of the nonradiative dielectric waveguide filter 10*f* is connected to the external reception circuit. In addition, the other input-output connection means 16*e*2 of the nonradiative dielectric waveguide filter 10*e* and the other input-output connection means 16*f*2 of the nonradiative dielectric waveguide filter 10*f* are integrated into an antenna connection means 19 so as to be connected to an antenna.

In the duplexer 30 having such a structure, the nonradiative dielectric waveguide filter 10*e* allows signals of a specified frequency to pass through, and the nonradiative dielectric waveguide filter 10*f* allows signals of different frequencies from those of the nonradiative dielectric waveguide filter 10*e* to pass through, so that it serves as a band pass duplexer.

Figure 22:
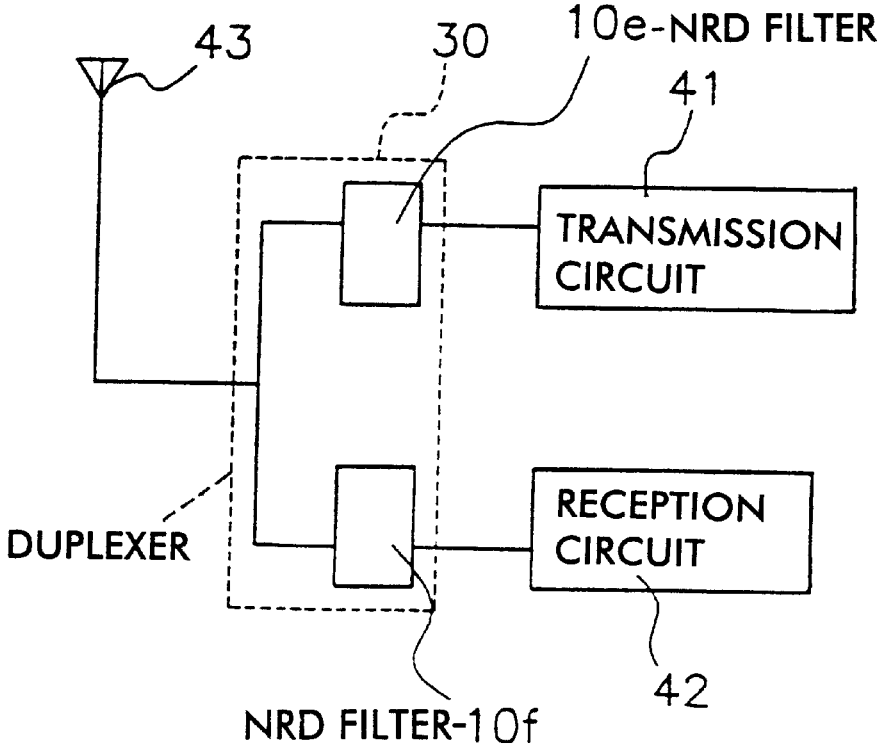
FIG. 22 is a schematic view of a transceiver according to the present invention.
Figure 23:
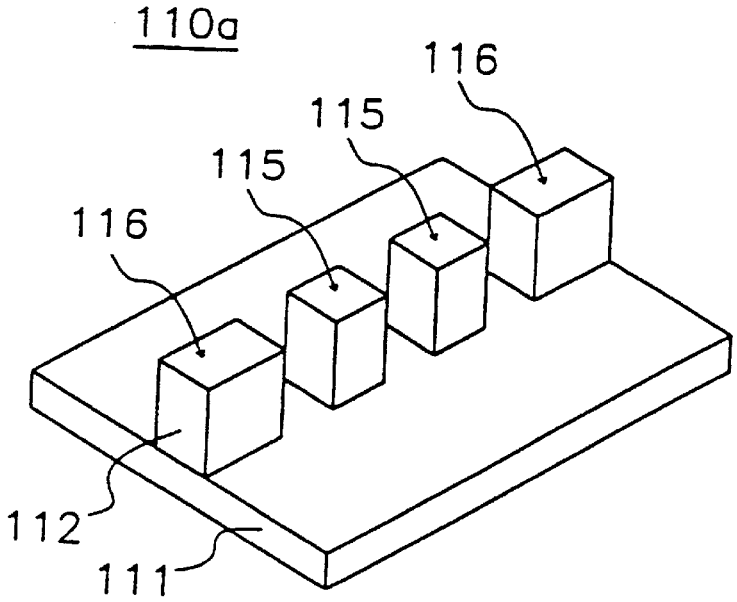
FIG. 23 PRIOR ART
FIG. 23 is a perspective view of a conventional nonradiative dielectric waveguide filter.
Figure 24:
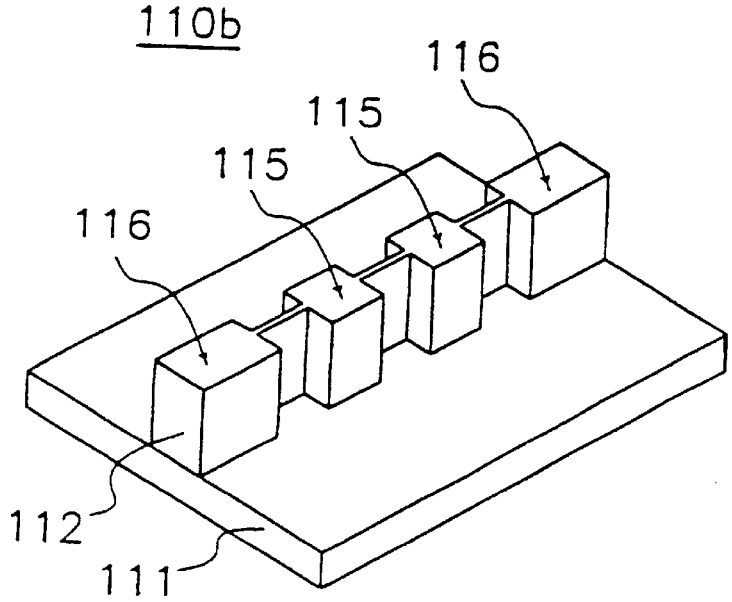
FIG. 24 PRIOR ART
FIG. 24 is a perspective view of another embodiment of a conventional nonradiative dielectric waveguide filter.

Referring to FIG. 22, a description will be given of a transceiver according to an embodiment of the present invention. FIG. 22 is a schematic view of the transceiver of the embodiment.

As shown in FIG. 22, the transceiver 40 of the present invention comprises the duplexer 30, a transmission circuit 41, a reception circuit 42, and an antenna 43. The duplexer 30 is the one used in the above embodiment. In this transceiver 40, the input-output connection means of the nonradiative dielectric waveguide filter 10*e* shown in FIG. 19 is connected to the transmission circuit 41, whereas the input-output connection means of the nonradiative dielectric waveguide filter 10*f* is connected to the reception circuit 42. Additionally, the antenna connection means is connected to the antenna 43.

As described above, according to the present invention, there is provided a nonradiative dielectric waveguide filter comprising planar conductors disposed substantially parallel to each other and a dielectric strip disposed therebetween. In this arrangement, for example, when the LSM mode is used, the dielectric strip is fitted into the groove formed in the upper and lower conductors and, furthermore, a plurality of lateral grooves is intermittently formed therein so as to form the nonradiative dielectric waveguide filter. This arrangement facilitates easy manufacture of the filter without complicating production of the dielectric strip, so that production efficiency can be enhanced, reducing manufacturing cost. Moreover, since the characteristics of resonance frequency, etc., are determined by the length of the lateral groove of the conductor, a nonradiative dielectric waveguide filter which can reduce characteristic changes with respect to temperature changes is obtainable.

What is claimed is:

1. A nonradiative dielectric waveguide resonator comprising:

a pair of opposing planar conductors;

a dielectric strip disposed therebetween and having a signal-transmitting direction;

at least one resonance region provided within said dielectric strip; and cut-off regions provided within the dielectric strip on both sides of the resonance region so as provide alternating regions of resonance and cut-off in the signal-transmitting direction of the dielectric strip.

2. The nonradiative dielectric waveguide resonator according to claim 1, wherein the dielectric strip is formed of dielectric material having uniform dielectric constant.

3. The nonradiative dielectric waveguide resonator according to one of claims 1 and 2, wherein a main signal-transmitting mode is the LSM mode; a first groove comprising a bottom and conductor walls is disposed in a conductor on a side thereof where the conductors are opposing; the resonance region is formed by fitting the dielectric strip into the first groove; and the cut-off regions are formed respectively grooves formed in said conductor adjacent to the dielectric strip having lower conductor walls than those of the first groove.

4. The nonradiative dielectric waveguide resonator according to claim 3, wherein the first groove comprises a bottom and conductor walls of at least a specified height.

5. The nonradiative dielectric waveguide resonator according to one of claims 1 and 2, wherein a main signal-transmitting mode is the LSE mode; a first groove comprising a bottom and conductor walls is disposed in a position in which the conductors are opposing; the cut-off regions are formed by fitting the dielectric strip into the first groove; and the resonance region is formed either by fitting the dielectric strip into a second groove having lower conductor walls than those of the first groove or by disposing the dielectric strip between the conductors having no grooves.

6. A nonradiative dielectric waveguide filter comprising: the nonradiative dielectric waveguide resonator according to one of claims 1 and 2, further comprising:

input-output connection units formed respectively by additional portions of the dielectric strip disposed between the conductors;

wherein the input-output connection units are coupled to the nonradiative dielectric waveguide resonator.

7. The nonradiative dielectric waveguide filter according to claim 6, wherein along its length dielectric strip has substantially the same cross-sectional shape taken perpendicular to the signal-transmitting direction;

wherein the input-output connection units are formed by fitting the dielectric strip into the first groove.

8. A duplexer comprising:

at least two filters; and an antenna connection means connected in common to the filters;

wherein at least one of the filters is the nonradiative dielectric waveguide filter described in claim 7.

9. A transceiver comprising:

the duplexer described in claim 8;

a transmission circuit connected to at least one of the input-output connection units of the duplexer;

a reception circuit connected to at least one of the input-output connection units, which is different from the input-output connection unit connected to the transmission circuit; and an antenna connected to the antenna connection of the duplexer.

10. A duplexer comprising:

at least two filters; and an antenna connection connected in common to the filters, for wherein at least one of the filters is the nonradiative dielectric waveguide filter described in claim 6.

11. A transceiver comprising:

the duplexer described in claim 10;

a transmission circuit connected to at least one of the input-output connection units of the duplexer;

a reception circuit connected to at least one of the input-output connection units, which is different from the input-output connection unit connected to the transmission circuit; and an antenna connected to the antenna connection of the duplexer.

* * * * *